US010328735B2

(12) United States Patent
Jagiello et al.

(10) Patent No.: US 10,328,735 B2
(45) Date of Patent: Jun. 25, 2019

(54) HEAT-SENSITIVE RECORDING MATERIAL

(71) Applicant: MITSUBISHI HITEC PAPER EUROPE GMBH, Bielefeld (DE)

(72) Inventors: Andreas Jagiello, Bielefeld (DE); Matthias Marx, Nortorf (DE); Martin Schreer, Melle (DE)

(73) Assignee: Mitsubishi HiTec Paper Europe GmbH, Bielefeld (DE)

( * ) Notice: Subject to any disclaimer, the term of this patent is extended or adjusted under 35 U.S.C. 154(b) by 0 days.

(21) Appl. No.: 15/537,359

(22) PCT Filed: Jun. 24, 2016

(86) PCT No.: PCT/EP2016/064676
§ 371 (c)(1),
(2) Date: Jun. 16, 2017

(87) PCT Pub. No.: WO2016/207356
PCT Pub. Date: Dec. 29, 2016

(65) Prior Publication Data

US 2017/0368859 A1 Dec. 28, 2017

(30) Foreign Application Priority Data

Jun. 24, 2015 (EP) ..... 15173719
Jul. 13, 2015 (EP) ..... 15176526

(51) Int. Cl.
*B41M 5/44* (2006.01)
*B41M 5/323* (2006.01)

(52) U.S. Cl.
CPC ..... *B41M 5/443* (2013.01); *B41M 5/323* (2013.01); *B41M 5/44* (2013.01); *B41M 2205/04* (2013.01); *B41M 2205/40* (2013.01)

(58) Field of Classification Search
CPC .... B41M 5/327; B41M 5/3275; B41M 5/333; B41M 5/3335; B41M 5/3336; B41M 5/42;
(Continued)

(56) References Cited

U.S. PATENT DOCUMENTS 7,476,643 B2 * 1/2009 Ikeda et al.
9,073,376 B2 * 7/2015 Ogino et al.
9,283,793 B2 * 3/2016 Ikeda et al.

FOREIGN PATENT DOCUMENTS

DE 44 25 737 2/1996
DE 198 06 433 8/1999
(Continued)

OTHER PUBLICATIONS

Office Action dated Oct. 18, 2018 issued in Korean Patent Application No. 10-2017-7024307.

*Primary Examiner* — Bruce H Hess
(74) *Attorney, Agent, or Firm* — Cozen O'Connor

(57) ABSTRACT

A heat-sensitive recording material has a web-shaped substrate, having a front side and a reverse side opposite the front side, a heat-sensitive recording layer disposed to the front side of the web-shaped substrate, including at least one dye precursor and at least one (color) developer reactive with this at least one dye precursor. A front-side surface of the heat-sensitive recording material is formed dehesively with respect to layers of adhesive applied to the reverse side of the web-shaped substrate. The dehesive front-side surface includes a furnish which is disposed above the heat-sensitive recording layer and comprises at least one release agent. A diffusion layer is formed between the furnish and the heat-sensitive recording layer. A method for producing a heat-sensitive recording material of this kind, and possibilities for its use.

20 Claims, 1 Drawing Sheet

(58) Field of Classification Search
CPC .... B41M 5/44; B41M 5/443; B41M 2205/04; B41M 2205/36; B41M 2205/38; B41M 2205/40
USPC ..... 503/200, 213, 216, 217, 221, 227; 427/150–152
See application file for complete search history.

(56) References Cited

FOREIGN PATENT DOCUMENTS

| | | |
|---|---|---|
| EP | 0 414 229 | 2/1991 |
| EP | 0 780 241 | 6/1997 |
| EP | 1 637 339 | 3/2006 |
| EP | 2 239 368 | 10/2010 |
| JP | 05-008541 | 1/1993 |
| JP | 06-072024 | 3/1994 |
| JP | 2002-079761 | 3/2002 |
| JP | 2002-532441 | 10/2002 |
| JP | 2006-035567 | 2/2006 |
| JP | 2006-062189 | 3/2006 |
| JP | 2006-088348 | 4/2006 |
| JP | 2006-095842 | 4/2006 |
| JP | 2014-080615 | 5/2014 |
| JP | 2014-126018 | 7/2014 |
| WO | WO 2013/069581 | 5/2013 |
| WO | WO 2014/126018 | 8/2014 |

* cited by examiner

HEAT-SENSITIVE RECORDING MATERIAL

CROSS REFERENCE TO RELATED APPLICATIONS

This is a U.S. national stage of application No PCT/EP2016/064676, filed on Jun. 24, 2016. Priority is claimed on European Application No.: 15173719.4, filed Jun. 24, 2015; and European Application No.: 15176526.0, filed Jun. 13, 2015 the contents of which are incorporated here by reference.

BACKGROUND OF THE INVENTION

1. Field of the Invention

The present invention relates to a heat-sensitive recording material having a web-shaped substrate and having a heat-sensitive recording layer disposed to the front side on the web-shaped substrate, the heat-sensitive recording layer comprising at least one dye precursor and at least one (color) developer that reacts with at least one dye precursor. To be reactive with a dye precursor means, in the sense of the present invention in all of its embodiments as herein proposed, that this at least one (color) developer, on sufficient supply of external heat, reacts with this at least one dye precursor to form a visually perceptible printed image. The surface of the heat-sensitive recording material is formed dehesively with respect to layers of adhesive that can be applied on the reverse side of the web-shaped substrate.

2. Description of the Prior Art

Heat-sensitive recording materials giving a color-forming reaction to the supply of external heat have been known for many years and have enjoyed a fundamentally undiminished popularity, a fact attributable among other things to the great advantages attaching to their use for the tradesman issuing tickets and/or sales receipts and/or entry cards. Because the color-forming components—that is, dye precursors and (color) developers, also called color acceptors, which react with said precursors on supply of heat in the case of a heat-sensitive recording process of this kind, reside within the recording material itself, the thermal printers, which are therefore free of toner and ink cartridges, and which no longer require regular servicing, can be installed in large numbers.

Extremely popular in this context are those heat-sensitive recording materials which to the front side have a recording layer, already discussed above in terms of its functional constituents, and to the reverse side have a layer of adhesive that enables the user to employ heat-sensitive recording materials as self-adhesive tickets. This innovative technology has become very comprehensively established to a particular degree in retail—for example, for the pricing of self-weighed products—and also in public transportation—for example, as luggage labels.

Up until the time of their use, the reverse-side layers of adhesive can be covered over by a separate release paper; significantly more popular and also more practical to operate, however, are recording materials which to the front side have surfaces formed dehesively with respect to the reverse-side layers of adhesive. In this case, up until their use, the reverse-side layers of adhesive are covered over by the front-sidedly dehesively formed surfaces of the recording materials themselves, wound up as a roll, where front side and reverse side meet in each case.

Thus DE 44 25 737 A1 explains directly in its first paragraph that in order to produce so-called release papers having dehesive properties with respect to layers of adhesive, it is possible for paper webs to be provided with a silicone layer. In order to prevent penetration of the silicone applied, which is unwanted in that situation, especially penetration of aqueous and above all of solvent-free silicone resins into the paper, a paper web is proposed, for later furnishing with silicone resins, that has been provided with a coating of waterglass. The proposal of a waterglass coating that is found in that specification is, on the one hand, unsuitable for heat-sensitive recording materials; on the other hand, after extensive investigations, the present inventors recognized that even the maximally effective avoidance of silicone penetration into a recording layer situated beneath the silicone furnish is not conducive to the formation of self-adhesive, heat-sensitive tickets.

Again with the objective of preventing fairly unwanted penetration of applied silicone into a base paper, EP 2 239 368 A1 proposes the surface coating of the base paper with subsequent calendering to a surface roughness <100 nm. This specification as well does not relate to heat-sensitive recording materials, and this specification as well, with the objective of extremely effective avoidance of silicone penetration, is oriented in a target direction contrary to the concepts of the invention proposed here.

Subject-matter of EP 0 780 241 B1 is a heat-sensitive recording material whose surface is particularly mechanically stable with respect to various printing processes and also has advantages in terms of water resistance, light stability, and graying. A heat-sensitive recording material proposed therein has a protective layer which features a UV-curing resin and a copolymer resin comprising a silicone component as copolymerizing component. This specification does not address heat-sensitive recording materials for self-adhesive tickets, even if it was found to be suitable for that purpose.

EP 1 637 339 B1 proposes a heat-sensitive recording material comprising a substrate, heat-sensitive recording layer, and protective layer, wherein the protective layer comprises binder resin, filler, crosslinking agent and a release agent. This release agent is introduced as a spherical and particulate silicone compound of specific formula. A disadvantage of this known proposal is the complicated and expensive production, with substrate, recording layer, and final protective layer, wherein the protective layer, because of its filler and binder constituents, surpasses itself by also reducing the dynamic and static sensitivity of the known heat-sensitive recording material with respect to external heat supplied in order to form a visually perceptible printed image.

Documents likewise relevant to the present application are WO 2013/069581 A1 and DE 198 06 433 A1.

SUMMARY OF THE INVENTION

It is an object of one ascpect of the present invention to provide a heat-sensitive recording material having compelling sensitivity toward external heat supplied in order to form a visual perceptible printed image, this recording material being able to be produced at moderate costs and to be implemented as a self-adhesive ticket with reverse-side adhesive layer without additional release paper.

BRIEF DESCRIPTION OF THE DRAWINGS

The FIGURE is a heat-sensitive recording material.

DETAILED DESCRIPTION OF THE PRESENTLY PREFERRED EMBODIMENTS

Figure 1:
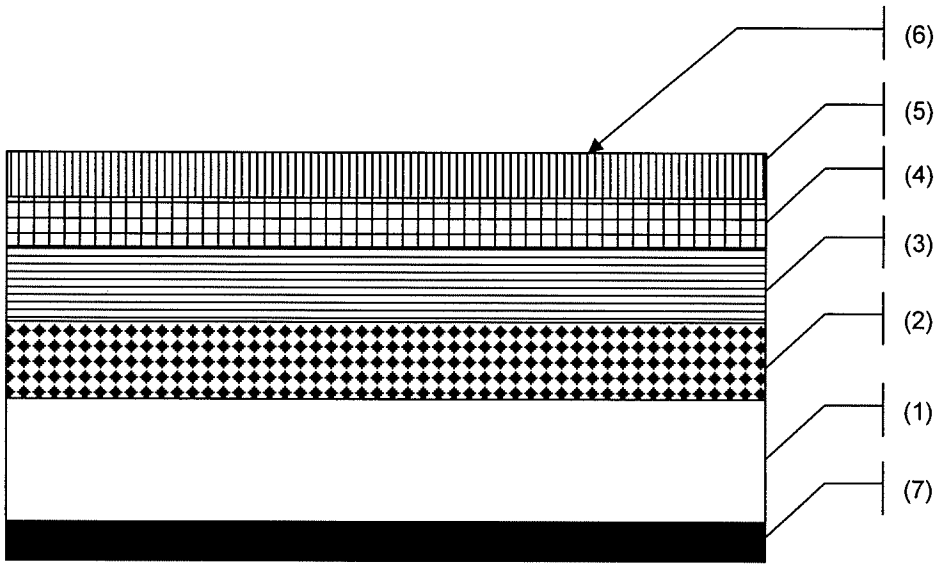

A heat-sensitive recording material is proposed having a web-shaped substrate (1), comprising a front side and a reverse side opposite the front side, a heat-sensitive recording layer (3) disposed to the front side of the web-shaped substrate (1), this heat-sensitive recording layer (3) comprising at least one dye precursor and at least one (color) developer which is reactive with this at least one dye precursor, a front-side surface (6) of the heat-sensitive recording material that is formed dehesively with respect to layers (7) of adhesive that can be applied to the reverse side of the web-shaped substrate (1), wherein the heat-sensitive recording material proposed here is characterized in that the heat-sensitive recording material, for the formation of its dehesive front-side surface (6), comprises a furnish (5) which is disposed above the heat-sensitive recording layer (3) and comprises at least one release agent, and a diffusion layer (4), formed between the at least one release agent-comprising furnish (5) and the heat-sensitive recording layer (3).

In our own studies it was established, surprisingly, that the diffusion layer (4) makes a substantial contribution to the inter-ply adhesion between the furnish (5) comprising a release agent, and the heat-sensitive recording layer (3). Without the diffusion layer (4), problems occurred with the inter-ply adhesion between the furnish (5) comprising a release agent, and the heat-sensitive recording layer (3), leading to problems in connection with the use of the recording material.

A further aspect in conjunction with the present invention concerns a heat-sensitive recording material comprising a web-shaped substrate (1) having a front side and a reverse side opposite the front side, a heat-sensitive recording layer (3) disposed on the front side of the web-shaped substrate (1), this heat-sensitive recording layer (3) comprising at least one dye precursor and at least one (color) developer which is reactive with this at least one dye precursor, a furnish (5) comprising a silicone component and disposed on the heat-sensitive recording layer (3), there being formed, in a furnish (5)-facing side of the heat-sensitive recording layer (3), a diffusion layer (4) containing a silicone component, a mass ratio between the silicone component in the recording layer (3) and the silicone component in the furnish (5) being 5:95 to 50:50, and the silicone components in the diffusion layer (4) and in the furnish (5) being materially identical.

It is preferred here if the silicone component of the recording layer (3) and the silicone component of the furnish (5) are joined covalently to one another.

Preferred heat-sensitive recording materials of the invention are those wherein the furnish (5) consists of the silicone component to an extent of at least 50 wt %, preferably at least 75 wt %, more preferably at least 85 wt %, based on the total weight of the furnish (5), the silicone component preferably being a polysilicone acrylate formed preferably by condensation of at least one silicone acrylate. As a result of a fraction of at least 50 wt %, the furnish is formed particularly dehesively with respect to adhesives which can be applied on the reverse side of the web-shaped substrate (1).

In the form of fully functional recording material, it preferably has a layer (7) of adhesive disposed on the reverse side of the web-shaped substrate (1). Since not only the dynamic but also the static sensitivity of the heat-sensitive recording layer relative to external heat supplied in order to produce a visually perceptible printed image is reduced by the furnish (5) comprising a release agent, something which, while not occurring to the same extent as in the case of a filler-containing protective layer, is nevertheless at least clearly perceptible, it is advantageous in the sense of the present invention if the presently proposed heat-sensitive recording material has an interlayer (2) comprising hollow pigments and positioned between the web-shaped substrate (1) and the heat-sensitive recording layer (3).

A heat-sensitive recording material of this kind is produced using a method, the method comprising at least the following steps:

forming a web-shaped substrate (1), having a front side and a reverse side opposite the front side, optionally:

providing a first coating composition, this first coating composition comprising at least hollow pigments, applying the provided first coating composition to form an interlayer (2) comprising hollow pigments, and drying the first coating composition, providing a second coating composition, this second coating composition comprising at least one dye precursor and at least one (color) developer which is reactive with this at least one dye precursor, applying the provided second coating composition to form a heat-sensitive recording layer (3) disposed to the front side of the web-shaped substrate (1), and drying the second coating composition, providing a third coating composition, this third coating composition comprising at least one release agent, applying the provided third coating composition, forming a diffusion layer (4) by areal diffusion of parts at least of the release agent from the applied third coating composition into the upper region of the heat-sensitive recording layer (3) formed, drying and/or crosslinking the third coating composition (preferably by means of high-energy radiation) to form the furnish (5) comprising a release agent, optionally:

providing a fourth coating composition, applying the provided fourth coating composition to form a layer (7) of adhesive disposed on the reverse side of the web-shaped substrate (1), and drying and/or crosslinking the fourth coating composition.

The heat-sensitive recording material is preferably produced using a method, the method comprising at least the following steps:

forming a web-shaped substrate (1), having a front side and a reverse side opposite the front side, optionally:

providing a first coating composition, this first coating composition comprising at least hollow pigments, applying the provided first coating composition to form an interlayer (2) comprising hollow pigments, and drying the first coating composition, providing a second coating composition, this second coating composition comprising at least one dye precursor and at least one (color) developer which is reactive with this at least one dye precursor, applying the provided second coating composition to form a heat-sensitive recording layer (3) disposed to the front side of the web-shaped substrate (1), drying the second coating composition, providing a third coating composition, this third coating composition comprising at least one release agent, applying the provided third coating composition, forming a diffusion layer (4) by areal diffusion of parts at least of the release agent from the applied third coating composition into the upper region of the heat-sensitive recording layer (3) formed, crosslinking the third coating composition by means of high-energy radiation to form the furnish (5) comprising a release agent, and optionally:

providing a fourth coating composition, applying the provided fourth coating composition to form a layer (7) of adhesive disposed on the reverse side of the web-shaped substrate (1), and drying and/or crosslinking the fourth coating composition.

A heat-sensitive recording material of the invention may alternatively be produced by means of a method comprising the following steps:

providing or producing a web-shaped substrate (1) having a front side and a reverse side opposite the front side, optionally:

providing or producing a first coating composition, this first coating composition comprising at least hollow pigments, applying the provided or produced first coating composition to form an interlayer (2) comprising hollow pigments, and drying the first coating composition, thereby forming an interlayer (2) comprising hollow pigments, providing or producing a coating composition, this coating composition comprising at least one dye precursor and at least one (color) developer which is reactive with this at least one dye precursor, applying the provided or produced coating composition to the front side of the web-shaped substrate (1), drying the applied coating composition, thus forming a heat-sensitive recording layer (3), providing or producing a third coating composition, this third coating composition comprising a silicone component, applying the provided or produced third coating composition, forming a diffusion zone by areal diffusion of parts at least of the silicone component of the applied third coating composition into the side of the heat-sensitive recording layer (3) that faces the applied third coating composition, drying and/or crosslinking the third coating composition, thereby forming a furnish (5) and a diffusion layer (4), and optionally:

providing or producing a fourth coating composition, comprising an adhesive or an adhesive precursor, applying the provided or produced fourth coating composition to the reverse side of the substrate (1), and drying and/or crosslinking the fourth coating composition, thereby forming a layer (7) of adhesive disposed on the reverse side of the web-shaped substrate (1).

It is preferred here if 5 wt % to 50 wt % of the silicone component, preferably 6 to 45 wt %, more preferably 7 to 4 wt %, especially preferably 8 to 32 wt %, of the applied third coating composition diffuses into the side of the heat-sensitive recording layer (3) that faces the applied third coating composition.

From the previous paragraphs it may be inferred that the diffusion layer (4) is formed by areal diffusion of parts at least of the release agent from the furnish (5) into the upper region, oriented toward the furnish (5), of the heat-sensitive recording layer (3) that is applied before the application of the furnish (5). For this purpose, first of all, the heat-sensitive recording layer (3) composed of the second coating composition is applied and dried either on the web-shaped substrate (1) or on the hollow-pigment-comprising interlayer (2) applied beforehand and fully formed. Applied to the heat-sensitive recording layer (3) fully formed in this way, then, is a previously prepared third coating composition, its application taking place preferably by a patterned-roller applicator mechanism or by a five-roll mill. This third coating composition comprises at least one release agent, this release agent preferably comprising at least one silicone component. Especially preferably the formula for the third coating composition comprises as the at least one release agent, a silicone component and/or a silicone acrylate and/or a silicone oil, at least one adhesion promoter as a component for manipulating the release force effect of the release agent, at least one substance which undergoes crosslinking reaction under the influence of high-energy radiation, more particularly ultraviolet radiation, and at least one photoinitiator.

In one preferred embodiment of the present invention, the coating composition and/or the silicone component has a viscosity of 50 to 1000 mPas, preferably of 50 to 100 mPas, or of 500 to 1000 mPas. It is especially preferred if the silicone component comprises an aqueous emulsion or a UV-crosslinking silicone component, the crosslinking taking place radically (preferably under a protective atmosphere of nitrogen) or cationically. In the case of an aqueous silicone emulsion, the furnish (5) may be formed by drying (and crosslinking optionally taking place at the same time) of the aqueous silicone emulsion, the drying taking place preferably gently in a temperature range between 40 and 60° C. With particular preference for the purposes of the present invention, the UV-crosslinking silicone component undergoes crosslinking with radical or cationic induction (after corresponding irradiation of high-energy radiation (e.g. UV radiation)). In the context of the present invention it is preferred if the silicone component is not a thermally crosslinking silicone component or a silicone component which is in solution in an organic solvent.

Following application of the third coating composition to the fully formed heat-sensitive recording layer (3), a part of the third coating composition diffuses into the upper region of the heat-sensitive recording layer (3) formed, a fraction of the entirety of the release agents of the third coating composition that diffuses into the upper region of the heat-sensitive recording layer (3) formed being from 5 to 50 wt %, preferably from 6 to 45 wt %, more preferably from 7 to 40 wt %, very preferably from 8 to 32 wt %. By drying and/or, in the case of a radiation-crosslinking third coating composition, by irradiation of the heat-sensitive recording material, including the applied third coating composition, with high-energy radiation, the furnish (5) comprising a release agent is then fully formed from the third coating composition, and the anchoring of this furnish (5) to the heat-sensitive recording layer (3) sited beneath it is ensured by means of the part of the third coating composition that has diffused into the recording layer. The upper region of the heat-sensitive recording layer (3), with the diffused-in part of the third coating composition, then forms the diffusion layer (4) by virtue of the aforementioned drying and/or crosslinking.

In various studies made in connection with the present invention, the inventors recognized that for the furnish (5) comprising release agent, a mass per unit area in a range from 0.5 g/m$^2$ to 3 g/m$^2$, preferably 0.8 g/m$^2$ to 1.85 g/m$^2$, more preferably 0.85 g/m$^2$ to 1.35 g/m$^2$ is particularly suitable, while at the same time the diffusion layer (4) as upper region in the heat-sensitive recording layer (3), with a preferred thickness of 0.2 μm to 0.8 μm, preferably 0.2 μm to 0.5 μm, in which a part of the third coating composition has diffused in, with a preferred computed mass per unit area for the diffusion layer (4) of 0.15 g/m$^2$ to 0.65 g/m$^2$, was recognized as an optimum.

In order to influence the amount of the diffusing-in part of the third coating composition into the heat-sensitive recording layer (3), an important part is ascribed to the binders and pigments which are incorporated preferably into the heat-sensitive recording layer (3). On the one hand it has emerged that it is very useful and therefore preferred if the heat-sensitive recording layer (3) comprises at least one preferably inorganic pigment selected from the list encompassing:

kaolinite (kaolin),
magnesium silicate hydrate (talc),
aluminum hydroxide,
calcium carbonate, and
silicon dioxide (silica).

It is especially preferred if the inorganic pigment is platelet-shaped in form, as is the case for kaolinite and talc, for example. Kaolinite and talc as inorganic pigment are therefore particularly preferred. It is likewise preferred, in particular, if the inorganic, platelet-shaped pigment (more particularly kaolinite and talc) has an aspect ratio (also called "shape factor") of 5 to 100, preferably of 15 to 100, especially preferably of 20 to 100. In one preferred embodiment the aspect ratio of the inorganic pigment is greater than 20. The aspect ratio is the quotient formed between the diameter and the thickness of the platelet of the inorganic pigment before being mixed with the other components. An aspect ratio of 20 means that the diameter of the platelet is 20 times greater than the thickness of the platelet.

Regarding the amount of pigment in the heat-sensitive recording layer (3), particular suitability is ascribed to a range from 8 to 18 wt % (bone dry), based on the total weight of the heat-sensitive recording layer (3), this range being narrowed at the lower end by the increasing risk of possible deposits on the thermal printhead and at the upper end by an increasing reduction in the sensitivity toward the thermal printhead heat that brings about the printed image.

On account of the hydrophobic property of silicone as preferred release agent in the third coating composition, diffusing into the heat-sensitive recording layer (3), it is considered preferred if the heat-sensitive recording layer (3) includes at least one hydrophilic binder. Particularly preferred here are binders selected from the list encompassing polyvinyl alcohol, styrene-butadiene latex, styrene-acrylate latex, starch, hydroxyethylcellulose, methylcellulose, ethylcellulose, carboxymethylcellulose, gelatin, casein, fully hydrolyzed polyvinyl alcohol, ethylene-vinyl acetate copolymer, polyvinyl alcohol-co-ethylene copolymer, carboxyl group-modified polyvinyl alcohol, acetoacetyl group-modified polyvinyl alcohol, diaceto group-modified polyvinyl alcohol, silanol group-modified polyvinyl alcohol, sulfonic acid group-modified polyvinyl alcohol, epoxy group-modified polyvinyl alcohol, chitosan, polyacrylic acid, polymethacrylic acid, polyacrylic ester, polymethacrylic ester, sodium polyacrylate, polyethylene terephthalate, polybutylene terephthalate, acrylic resin, furan resin, ketone resin, oxybenzoyl polyester, polyacetal, polyether ketone, polyether sulfone, polyamide, polyamideimide, polyaminobismaleimide, polymethylpentene, polyphenylene oxide, polyphenylene sulfide, polyphenylene sulfone, polysulfone, polyallylate, polyallylsulfone, polybutadiene, polycarbonate, polyethylene, polypropylene, polystyrene, polyvinyl acetate, acrylonitrile/butadiene copolymer, and acrylamide/acrylic ester/methacrylic acid terpolymer.

Especially preferred here are binders selected from the list encompassing:

ethylene-vinyl acetate copolymer,
polyvinyl alcohol,
styrene-butadiene latex,
styrene-acrylate latex,
starch,
methylcellulose, and
polyvinyl alcohol-co-ethylene copolymer.

It is preferred if the polyvinyl alcohol used as binder has a degree of hydrolysis of more than 97 mol %, preferably a degree of hydrolysis of 97 mol % to about 99 mol %, or alternatively of more than 99 mol %, and a viscosity, measured according to DIN 53015 on an aqueous solution at 4 mass % and 20° C., of more than 7 mPas, preferably more than 12 mPas, more preferably more than 15 mPas. Especially preferable is a polyvinyl alcohol (PVA) 15-99, preferably having a degree of hydrolysis of 99 to 99.8 mol %, or a corresponding PVA of higher degree of hydrolysis and/or higher viscosity than PVA 15-99.

In one preferred embodiment of the invention, the binder comprises crosslinking (self-crosslinking or externally crosslinking) and/or modified polyvinyl alcohol, the modified polyvinyl alcohol preferably being diacetone-modified polyvinyl alcohol, silanol group-modified polyvinyl alcohol, carboxyl group-modified polyvinyl alcohol and/or a polyvinyl alcohol-co-ethylene copolymer, preferably diacetone-modified polyvinyl alcohol or silanol group-modified polyvinyl alcohol and/or a polyvinyl alcohol-co-ethylene copolymer.

Particularly if the binder used comprises a non-self-crosslinking polyvinyl alcohol, it is preferable, in one preferred embodiment of the present invention, if the heat-sensitive recording layer (3) comprises at least one crosslinking assistant selected from the list encompassing: boric acid, polyamine, epoxy resin, dialdehyde, formaldehyde oligomers, epichlorohydrin resin, adipic dihydrazide, dimethylurea, and melamine-formaldehyde, alone or in a blend with one another.

In one embodiment of the present invention, ethylene-vinyl acetate copolymer is used as sole binder or, in conjunction with polyvinyl alcohol, as a particularly preferred binder, which, based on the total weight of the heat-sensitive recording layer (3), is incorporated in a range from 10 to 20 wt % into the heat-sensitive recording layer (3).

The proposed method envisages the preparing of a second coating composition to form a heat-sensitive recording layer (3) disposed to the front side of the web-shaped substrate (1); particularly appropriate for this purpose is the use of container balances for the precise supplying and metering of heaped components and liquid components.

The second coating composition intended for forming the heat-sensitive recording layer (3) preferably comprises at least one (color) developer selected from the list encompassing:

4-[(4-(1-methylethoxy)phenyl)sulfonyl]phenol,

N-(p-toluenesulfonyl)-N'-3-(p-toluenesulfonyloxyphenyl)urea, diisopropyldiphenol, 4,4-sulfonyldiphenol, and N-[2-(3-phenylureido)phenyl]benzenesulfonamide, of which, in a very particular degree, N-(p-toluenesulfonyl)-N'-(3-p-toluenesulfonyloxyphenyl)urea and N-[2-(3-phenylureido)phenyl]benzenesulfonamide are preferred. The stated (color) developers on the one hand ensure sufficient stability toward those ingredients of the layer (7) of adhesive whose diffusion into the heat-sensitive recording layer (3) can never be entirely prevented. On the other hand they also ensure sufficient sensitivity toward external heat supplied in order to bring about a visually perceptible printed image.

The heat-sensitive recording material comprises, as dye precursors in the second coating composition for forming the heat-sensitive recording layer (3), preferably those selected from the list encompassing 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, 3-(N-ethyl-N-tetrahydrofuryl)amino-6-methyl-7-anilinofluoran, 3-di-n-pentyl-amino-6-methyl-7-anilinofluoran, 3-di-n-butylamino-7-(2-chloroanilino) fluoran, 3-diethylamino-7-(2-chloroanilino)fluoran, 3-diethylamino-6-methyl-7-xylidinofluoran, 3-diethylamino-7-(2-carbomethoxyphenylamino)fluoran, 3-(N-cyclopentyl-N-ethyl)amino-6-methyl-7-anilinofluoran, 3-(N-ethyl-4-toluidino)-6-methyl-7-(4-toluidino)fluoran, 3-(N-methyl-N-tetrahydrofurfuryl)amino-6-methyl-7-anilinofluoran), 3-pyrrolidino-6-methyl-7-anilinofluoran, 3-pyrrolidino-6-methyl-7-(4-n-butylphenylamino)fluoran, and 3-piperidino-6-methyl-7-anilinofluoran. More preferably those selected from the list encompassing 3-diethylamino-6-methyl-7-anilinofluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tolyl)amino-6-methyl-7-anilinofluoran, and 3-(N-ethyl-N-tetrahydrofuryl) amino-6-methyl-7-anilinofluoran. Especially preferred here is 3-dibutylamino-6-methyl-7-anilinofluoran-also known as ODB-2.

The second coating composition for forming the heat-sensitive recording layer (3) may contain, for the purpose of increasing the thermal response sensitivity, at least one sensitizer selected from the list encompassing N-hydroxymethylstearamide, N-stearylstearamide, ethylenebisstearamide, N-stearylurea, benzyl 2-naphthyl ether, m-terphenyl, 4-benzybiphenyl, 1,2-bis(3-methylphenoxy)ethane, 1,2-diphenoxyethane, 2,2'-bis(4-methoxyphenoxy) diethyl ether, α,α'-diphenoxyxylene, bis(4-methoxyphenyl) ether, diphenyl adipate, dibenzyl oxalate, bis(4-chlorobenzyl) oxalate ester, dibenzyl terephthalate, benzyl paraben, phenyl benzenesulfonate ester, 4,4'-diallyloxydiphenyl sulfone, diphenyl sulfone, 4-acetylacetophenone, acetoacetanilides, fatty acid anilides, salicylanilide, stearamide, dimethyl sulfone, 2-(2H-benzotriazol-2-yl)-p-cresol, and dimethyl terephthalate. The second coating composition preferably comprises at least one sensitizer selected from the list encompassing benzyl 2-naphthyl ether, 1,2-bis(3-methylphenoxy)ethane, and 1,2-diphenoxyethane. In accordance with a first preferred embodiment, these sensitizers are used in each case alone, in other words not in combination with the other stated sensitizers from the list above. In accordance with a second, likewise preferred embodiment, at least two sensitizers selected from the list above are incorporated in the second coating composition.

Appropriate coating apparatus for applying the second coating composition in order to form the heat-sensitive recording layer (3) comprises, in particular, a roller blade coater, a knife coater, a curtain coater, or an airbrush. The mass per unit area of the heat-sensitive recording layer (3), including the preferred computed mass per unit area for the diffusion layer (4) of 0.15 $g/m^2$ to 0.65 $g/m^2$, is between 2.4 to 6.2 $g/m^2$, preferably between 2.5 and 6.2 $g/m^2$, and more preferably still between 2.5 and 4.9 $g/m^2$.

Particularly for improving both the dynamic and the static sensitivity of the heat-sensitive recording material proposed here, the recording material proposed here preferably has an interlayer (2), comprising hollow pigments and positioned between the web-shaped substrate (1) and the heat-sensitive recording layer (3), such an interlayer being of the kind already set out earlier on above within the description. The reason for the high importance of the organic hollow pigments in the interlayer (2) is that such organic pigments are particularly beneficial to high heat reflection capacity on the part of the interlayer (2). The hollow pigments feature air in their interior, which represents a good insulator of heat. Consequently, the interlayer (2), optimized in this way as a heat reflection layer, quite specifically raises the responsiveness of the recording layer (3) with respect to heat.

Besides the organic hollow pigments, the interlayer (2) especially preferably also comprises inorganic pigments, the inorganic pigments being selected, individually or in combination with one another, from the list encompassing: natural and calcined kaolin, silicon oxide, and particularly bentonite, calcium carbonate, and also aluminum hydroxide, and particularly boehmite. The thermal head that initiates the color-forming reaction of the dye precursors with the (color) developers in the heat-sensitive recording layer (3) brings about melting of waxy constituents in the recording layer (3). The inorganic pigments preferably incorporated in the interlayer (2) also bring about absorption of this melt. It is especially advantageous here if the inorganic pigments of the interlayer (2) have an oil absorption of at least 80 $cm^3/100$ g and more preferably still of 100 $cm^3/100$ g, determined in accordance with the Japanese Standard JIS K 5101. This requirement is met by the inorganic pigments designated above.

The proportion between the entirety of organic hollow pigments and the entirety of inorganic pigments within the interlayer (2) is a compromise between the effects produced by the two types of pigment, this compromise being solved to particular advantage when the pigment mixture consists to an extent of 5 to 30 wt %, or more preferably 8 to 20 wt %, of organic pigment and of 95 to 70 wt %, or more preferably of 92 to 80 wt %, in inorganic pigment. Pigment mixtures composed of different organic pigments and/or of different inorganic pigments are conceivable.

Besides the organic hollow pigments and optionally also inorganic pigments, the interlayer (2) comprises at least one binder preferably based on a synthetic polymer, with styrene-butadiene latex, for example, affording particularly good results. The use of a synthetic binder with admixture of at least one natural polymer, such as starch with particular preference, represents a particularly suitable embodiment. In the course of experiments with different organic and inorganic pigments it has additionally been observed that a particularly suitable embodiment is present with a binder/pigment ratio within the interlayer of between 3:7 and 1:9, based in each case on wt %.

The first coating composition for forming the interlayer (2) is applied preferably by a leveling coating technique, selected from the list encompassing: roll coater, knife coater, and (roller) blade coater. Specifically with the use of one of these stated coating methods, the interlayer (2) is able to make a positive contribution to leveling the substrate surface, hence reducing the amount of the second coating composition to be applied for forming the heat-sensitive recording layer (3). The subsequent drying of the coating composition to form the interlayer (2) is customarily accomplished by supply of heat, as through hot air flotation dryers or else contact dryers. Also proven is a combination of hot air flotation dryer and contact dryer. For the mass per unit area of the interlayer (2), a preferred range of between 5 and 20 g/m$^2$ and more preferably between 7 and 12 g/m$^2$ has proven itself.

In one embodiment of the present invention, instead of the interlayer (2) comprising hollow pigments, an interlayer is used between the web-shaped substrate (1) and the heat-sensitive recording layer (3) that comprises not hollow pigments but rather inorganic pigments, the inorganic pigments preferably being selected, individually or in combination with one another, from the list encompassing: natural or calcined kaolin, silicon oxide and more particularly bentonite, calcium carbonate, and also aluminum hydroxide and more particularly boehmite.

Although not confined to paper as web-shaped substrate (1), paper, and specifically here a coating base paper that has not been surface-treated, is the substrate that has established itself on the market, not least in respect of the high eco-friendliness on account of the high recyclability, and that is preferred for the purposes of the invention. A coating base paper which has not been surface-treated refers to a coating base paper which is not treated in a size press or in a coating apparatus. Equally possible for the invention are films composed for example of polypropylene, polyolefin, and polyolefin-coated papers as web-shaped substrate (1), without any such listing having an exclusive character.

The information provided in the description and in the claims in relation to mass per unit area, to wt % (weight %), and to parts by weight (parts by weight) is based in each case on the "bone dry" weight, i.e., absolutely dry parts by weight. In the observations concerning the organic pigments in the pigment-containing interlayer, the numerical information in this regard is calculated from the "air dry" weight, i.e., air-dry parts by weight, minus the weight fraction of water around and within the pigments in their as-supplied form.

A further aspect of the present invention is the use of a heat-sensitive recording material of the invention as self-adhesive ticket, self-adhesive entry card, self-adhesive proof of purchase, self-adhesive label or self-adhesive entry cards.

A further aspect of the present invention is a heat-sensitive recording material produced by a method of the invention.

In the context of the present invention, preferably two or more of the aspects identified above as being preferred are realized simultaneously; especially preferred are the combinations of such aspects, and of the corresponding features, that emerge from the appended claims.

The invention is to be illustrated further by the following examples:

EXAMPLE 1

Various heat-sensitive recording materials are produced, with different masses per unit area, of 2.4 g/m$^2$, 2.5 g/m$^2$, 3.0 g/m$^2$, 4.0 g/m$^2$, 5.0 g/m$^2$, and 6.2 g/m$^2$. The web-shaped substrate used (base paper) is the base paper described in example 2, having a mass per unit area of 64 g/m$^2$. The aqueous coating slips used for this heat-sensitive recording layer (3) contain the following components in accordance with the formulations reproduced in table 1:

TABLE 1

Amounts in wt % (bone dry), based on the total weight of the heat-sensitive recording layer

| | | | | |
|---|---|---|---|---|
| Dye precursor | 3-dibutylamino-6-methyl-7-anilinofluoran (ODB-2) | 9 | 9 | 9 |
| (color) developer | N-(p-toluenesulfonyl)-N'-3-(p-toluenesulfonyloxy-phenyl)urea (Pergafast ® 201 (BASF)) | 20 | 20 | 20 |
| Sensitizer | benzyl 2-naphthyl ether (BNE) | 16 | 16 | |
| | 1,2-diphenoxyethane | | | 16 |
| Binder | polyvinyl alcohol | 15 | | |
| | polyvinyl alcohol-co-ethylene copolymer (EVOH) | | 15 | 15 |
| Cobinder | acrylate copolymer | 10 | | 10 |
| | methylcellulose | 2 | | 2 |
| Pigment | talc (platelet-shaped with an aspect ratio of 25) | 16 | | 16 |
| | | 88 | | |

Applied atop this heat-sensitive recording layer in each case by a roller blade coater is a heat-sensitive recording layer with a mass per unit area of 2.5 g/m$^2$. The aqueous coating slip used for this purpose contains the following components, according to the formulation reproduced in table 2.

EXAMPLE 2

The web-shaped substrate used is a base paper having a mass per unit area of 64 g/m$^2$, produced on a Fourdrinier paper machine from bleached and ground hardwood and softwood pulps, with addition, based on the overall solids content (bone dry) of the pulp supplied to the paper machine, of 0.8 wt % of AKD size as a stock sizing, and also of other customary adjuvants.

Applied to the front side is an interlayer comprising calcined kaolin as pigment, styrene-butadiene latex as binder and, in addition to other auxiliaries, starch as cobinder, this interlayer being applied with a mass per unit area of 9 g/m$^2$, using a coating knife.

Applied atop this pigmented interlayer by means of a roller blade coater is a heat-sensitive recording layer with a mass per unit area of 2.5 g/m$^2$. The aqueous coating slip used for this purpose contains the following components, according to the formulation reproduced in table 2:

TABLE 2

Amounts in wt % (bone dry), based on the total weight of the heat-sensitive recording layer

| | | |
|---|---|---|
| Dye precursor | 3-dibutylamino-6-methyl-7-anilinofluoran (ODB-2) | 9 |
| (color) developer | N-(p-toluenesulfonyl)-N'-3-(p-toluenesulfonyloxyphenyl)urea (Pergafast ® 201 (BASF)) | 20 |

TABLE 2-continued

| Amounts in wt % (bone dry), based on the total weight of the heat-sensitive recording layer | | |
|---|---|---|
| Sensitizer | benzyl 2-naphthyl ether (BNE) | 16 |
| Binder | polyvinyl alcohol-co-ethylene copolymer (EVOH) | 15 |
| Cobinder | acrylate copolymer | 10 |
| | methylcellulose | 2 |
| Pigment | talc (platelet-shaped with an aspect ratio of 25) | 16 |
| | | 88 |

Further constituents of the heat-sensitive recording layer, not stated in percentage terms and based on the total weight in wt % (bone dry), include dispersants, defoamers, optical brighteners, thickeners, waxes, and crosslinkers.

Following the application of the heat-sensitive recording layer, it is dried and calendered, and here a value of 500 Bekk/sec (DIN ISO 53107) is measured for the front-side surface smoothness.

The web-shaped substrate produced, with interlayer and heat-sensitive recording layer, is coated to the front side (on to the heat-sensitive recording layer) with a radically curing standard UV silicone system, using a patterned roll applicator. The solvent-free Evonik standard silicone system used for this purpose comprises a formulation which is reproduced in table 3. The silicone addon here is approximately 1.2 g/m$^2$.

TABLE 3

| | |
|---|---|
| RC-711 silicone acrylate | 25 parts by weight |
| RC-902 silicone acrylate | 50 parts by weight |
| RC-1772 silicone acrylate (mixture with matting agent) | 25 parts by weight |
| TEGO photoinitiator A-18 | 2 parts by weight |

The furnish thus obtained, comprising release agent, is cured fully with a UV lamp (80 W/cm) under a protective gas atmosphere of nitrogen.

This gives a heat-sensitive recording material of the invention, in which the furnish layer comprising release agent does not detach from the heat-sensitive recording layer. Even after storage for 30 days, the furnish layer comprising release agent cannot be detached from the heat-sensitive recording layer. The sensitivity of the recording material produced is good.

EXAMPLE 3

Example 2 was repeated, except that the composition of the pigmented interlayer was modified. The modified composition of the pigmented interlayer is indicated in table 4.

TABLE 4

| | |
|---|---|
| Water | 100 parts by weight |
| 30% dispersion of fine hollow particles (particle size: 0.45 μm) | 300 parts by weight |
| 25% solution of oxidized starch | 24 parts by weight |
| 48% latex (glass transition temperature: 0° C.) | 25 parts by weight |

This provides a heat-sensitive recording material of the invention in which the furnish layer comprising release agent does not detach from the heat-sensitive recording layer. Even after storage for 30 days, the furnish layer comprising release agent cannot be detached from the heat-sensitive recording layer. The sensitivity of the recording material produced is good.

EXAMPLE 4

A layer of adhesive was produced on the reverse side of the web-shaped substrate of the heat-sensitive recording layer produced in example 2, by application of a polyacrylic resin adhesive.

The web-shaped substrate was subsequently rolled up, causing the layer of adhesive to lie on the furnish layer comprising a release agent. Even after storage for 30 days, individual plies of the heat-sensitive recording material can be unrolled, without the furnish layer comprising release agent detaching from the heat-sensitive recording layer, or residues of the layer of adhesive remaining on the furnish layer comprising a release agent.

EXAMPLE 5

A layer of adhesive was produced on the reverse side of the web-shaped substrate of the heat-sensitive recording layer produced in example 3, by application of a polyacrylic resin adhesive.

The web-shaped substrate was subsequently rolled up, causing the layer of adhesive to lie on the furnish layer comprising a release agent. Even after storage for 30 days, individual plies of the heat-sensitive recording material can be unrolled, without the furnish layer comprising release agent detaching from the heat-sensitive recording layer, or residues of the layer of adhesive remaining on the furnish layer comprising a release agent.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A heat-sensitive recording material, comprising:

a web-shaped substrate, having a front side and a reverse side opposite the front side;

a heat-sensitive recording layer disposed to the front side of the web-shaped substrate, comprising at least one dye precursor and at least one (color) developer reactive with this at least one dye precursor;

at least one layer of adhesive applied to the reverse side of the web-shaped substrate;

a front-side surface of the heat-sensitive recording material that is formed dehesively with respect to the at least one layer of adhesive;

a furnish disposed above the heat-sensitive recording layer and comprises a silicone component as at least one release agent, wherein the dehesively formed layer is a top surface of the furnish; and a diffusion layer formed between the furnish and the heat-sensitive recording layer, the diffusion layer being formed by areal diffusion of parts at least of the at least one release agent from the furnish into an upper region, oriented toward the furnish, of the heat-sensitive recording layer applied before application of the furnish, wherein a fraction of the at least one release agent of the furnish that diffuses into the upper region of the heat-sensitive recording layer formed being from 5 to 50 wt %.

2. The heat-sensitive recording material as claimed in claim 1, wherein a fraction of 6 to 45 wt % of an entirety of the at least one release agent of the furnish diffuses into the upper region of the heat-sensitive recording layer formed.

3. The heat-sensitive recording material as claimed in claim 1, wherein the heat-sensitive recording layer comprises at least one platelet-shaped pigment.

4. The heat-sensitive recording material as claimed in claim 3, wherein the at least one platelet-shaped pigment has an aspect ratio of 5 to 100.

5. The heat-sensitive recording material as claimed in claim 3, wherein the at least one platelet-shaped pigment has an aspect ratio of 15 to 100.

6. The heat-sensitive recording material as claimed in claim 3, wherein the at least one platelet-shaped pigment has an aspect ratio of 20 to 100.

7. The heat-sensitive recording material as claimed in claim 1, wherein the furnish is UV-crosslinking.

8. The heat-sensitive recording material as claimed in claim 1, wherein the heat-sensitive recording material has an interlayer positioned between the web-shaped substrate and the heat-sensitive recording layer and comprising hollow pigments.

9. The heat-sensitive recording material as claimed in claim 1, wherein the heat-sensitive recording layer comprises at least one (color) developer selected from the group consisting of:

4-[(4-(1-methylethoxy)phenyl)sulfonyl]phenol,

N-(p-toluenesulfonyl)-N'-3-(p-toluenesulfonyloxyphenyl)urea, diisopropyldiphenol, 4,4-sulfonyldiphenol, and N-[2-(3-phenylureido)phenyl]benzenesulfonamide.

10. The heat-sensitive recording material as claimed in claim 9, wherein the heat-sensitive recording layer comprises at least one (color) developer selected from the group consisting of:

N-(p-toluenesulfonyl)-N'-3-(p-toluenesulfonyloxyphenyl)urea, and

N-[2-(3-phenylureido)phenyl]benzenesulfonamide.

11. The heat-sensitive recording material as claimed in claim 1, wherein the heat-sensitive recording layer comprises 3-dibutylamino-6-methyl-7-anilinofluoran as the at least one dye precursor.

12. The heat-sensitive recording material as claimed in claim 1, wherein the heat-sensitive recording layer comprises at least one hydrophilic binder.

13. The heat-sensitive recording material as claimed in claim 1, wherein the heat-sensitive recording layer comprises as binder at least one component selected from the group consisting of:

ethylene-vinyl acetate copolymer, polyvinyl alcohol, styrene-butadiene latex, styrene-acrylate latex, starch, methylcellulose, and polyvinyl alcohol-co-ethylene copolymer.

14. The heat-sensitive recording material as claimed in claim 1, wherein the heat-sensitive recording layer comprises at least one pigment selected from the group consisting of:

kaolinite (kaolin), magnesium silicate hydrate (talc), aluminum hydroxide, calcium carbonate, and silicon dioxide (silica).

15. The heat-sensitive recording material as in claim 1, wherein the heat-sensitive recording material is a self-adhesive ticket.

16. The heat-sensitive recording material as claimed in claim 1, wherein a fraction of 7 to 40 wt % of an entirety of the release agents of the furnish diffuses into the upper region of the heat-sensitive recording layer formed.

17. The heat-sensitive recording material as claimed in claim 1, wherein a fraction of 8 to 31 wt % of an entirety of the release agents of the furnish diffuses into the upper region of the heat-sensitive recording layer formed.

18. A method for producing a heat-sensitive recording material comprising:

forming a web-shaped substrate, having a front side and a reverse side opposite the front side;

providing a first coating composition, this first coating composition comprising at least one dye precursor and at least one (color) developer reactive with the at least one dye precursor;

applying the provided first coating composition to form a heat-sensitive recording layer disposed to the front side of the web-shaped substrate;

drying the first coating composition;

providing a second coating composition, this second coating composition comprising at least one release agent;

applying the provided second coating composition;

forming a diffusion layer by areal diffusion of parts at least of a release agent from the applied second coating composition into an upper region of the heat-sensitive recording layer formed; and drying and/or crosslinking the second coating composition to form a furnish comprising a release agent.

19. The method for producing a heat-sensitive recording material as claimed in claim 18, comprising at least one of:

providing an initial coating before the first coating composition comprising at least hollow pigments;

applying the initial coating composition to form an interlayer comprising hollow pigments; and drying the initial coating composition.

20. The method for producing a heat-sensitive recording material as claimed in claim 18, comprising at least one of:

providing a third coating composition, applying the third coating composition to form a layer of adhesive disposed on the reverse side of the web-shaped substrate; and drying and/or crosslinking the third coating composition.

* * * * *